United States Patent [19]

Dean

[11] 4,373,310

[45] Feb. 15, 1983

[54] STAIRCASE HANDRAIL CONSTRUCTION

[76] Inventor: Robert Dean, 406 S. Shiawassee, Owosso, Mich. 48867

[21] Appl. No.: 140,315

[22] Filed: Apr. 14, 1980

[51] Int. Cl.[3] ..... E04F 11/00

[52] U.S. Cl. ..... 52/182; 52/187; 256/65; 403/199

[58] Field of Search ..... 52/187, 301, 182; 256/65, 72; 403/187, 199

[56] References Cited

U.S. PATENT DOCUMENTS

| | | | |
|---|---|---|---|
| 705,794 | 7/1902 | Snider . | |
| 1,019,561 | 3/1912 | Tresidder | 52/301 |
| 1,031,645 | 7/1912 | Haskell . | |
| 2,869,829 | 1/1959 | Spandberg | 256/72 X |
| 3,207,259 | 9/1965 | Gebhart . | |
| 3,430,729 | 3/1969 | Miceli . | |
| 3,748,802 | 7/1973 | Verderio | 52/187 |
| 3,795,453 | 3/1974 | Condevaux | 256/65 X |
| 3,902,948 | 9/1975 | Morros | 156/222 |
| 3,991,981 | 11/1976 | Wu | 256/65 |
| 4,050,828 | 9/1977 | Noro | 256/65 X |
| 4,118,908 | 10/1978 | Bucher | 52/185 |
| 4,132,391 | 1/1979 | Takenaga | 256/59 |

*Primary Examiner*—Carl D. Friedman
*Attorney, Agent, or Firm*—Gifford, VanOphem, Sheridan & Sprinkle

[57] ABSTRACT

A handrail support assembly has a tee member fitting into a support baluster above each tread of a spiral staircase. The upper cross member of the tee member fits into channels formed under the handrail. The channels are formed by return bending the sides of the rail. The tee member will support and position a spiral rail while being rotatable somewhat in the channels of the rail so that a predrilled nonprecision hole in the lower portion of the tee member may be aligned with a hole in the baluster for attachment with a screw. Precision components are avoided.

6 Claims, 5 Drawing Figures

STAIRCASE HANDRAIL CONSTRUCTION

BACKGROUND OF THE INVENTION

I. Field of the Invention

This invention relates to spiral staircases and handrails therefor, more particularly to constructions for supporting a continuous handrail on posts along a staircase.

II. Description of the Prior Art

Various types of spiral staircases and the like have been shown in the past and most include a handrail associated therewith such as is shown in FIG. 1 of U.S. Pat. No. 1,031,645 to Haskell. In the past, it has been difficult to use a continuous piece of metal as the handrail for such spiral staircases because precision support pieces were require for proper alignment of the rail above the treads of the staircase. Many devices have been disclosed for securing the handrail to the treads of the staircase by balusters or posts, but all these devices suffer from the disadvantage that they require precision positioning of the handrail and precision drilling of the support and attachment mechanisms for the handrail. The alternative to this was to form screw bores and the like in the pieces on site when installing the staircase and handrail. Even in such a case, installation and fitting of the handrail was difficult and expensive. Furthermore, the attachment mechanisms were extremely complicated such as is shown by Takenaga in U.S. Pat. No. 4,132,391.

An additional problem with handrails of the prior art was that the sides of the rail were either rough or subject to being bent when formed in a manner that would facilitate attachment to balusters for support above the treads of the staircase. Attempts to form a curved spiral handrail often resulted in a crushed portion of the handrail where attachment was to be made. Thus, handrails of the prior art are conventionally formed of multiple pieces and assembled by interjoining the pieces end to end.

SUMMARY OF THE INVENTION

Applicant has overcome the problems of the prior art by providing a spiral staircase and handrail therefor wherein the handrail and supports therefor may be preformed and predrilled for assembly without presenting any problems in assembling the handrail on site and without presenting the necessity of drilling fitting holes when the handrail is assembled.

Applicant has devised a handrail having curved sides which form channels thereunder to be used with an interlocking tee member. The tee member is in turn engageable with a baluster or post supporting the rail above the treads. The engagement between the post and tee member as well as between the tee member and rail is somewhat adjustable so that preformed securing mechanisms such as screws and bores may be used for assembly of the handrail. Furthermore, a minimum number of parts are required since the tee members simply slide in the channels formed by the sides of the handrails and curved thereunder. Various other possible formations of the handrail are also suitable for the invention so long as a tee member is adjustable within the channels formed below the rail.

Preferably, the tee member has an upper cross member which is in the shape of a small pin and can be turned to fit fairly snugly when disposed perpendicular to the section of rail where it is fitted; i.e., perpendicular to the channels of the rail. The lower portion of the tee member may be formed so as to fit into the top of a post or alternatively to fit about the top of a post so that the lower portion of the tee member and post may be secured together such as by means of a screw or equivalent.

Preferably, the lower section of the tee member and the post are cylindrical in cross section so that the tee member may be rotated somewhat in the channels of the rail so as to align, for example, predrilled holes which may then be used to secure the tee member to the handrail. However, it is possible to provide the tee member and balusters or posts of the invention in a cross-sectional material other than cylindrical such as, for example, square or hexagonal. In such a case, however, there is little play in the adjustment of the upper pin of the tee member in the rail channels. The lower portion of the baluster or post is secured to the steps or, in the case of the bottom balluster, the floor by conventional means such as screws in plates and the like.

It is to be noted that the upper horizontal pin member of the tee member is formed so as to conform to the shape of the handrail when disposed across the width thereof, thus eliminating the need for any additional screws or the like to secure the upper section of the tee member to the handrail. When a number of balusters and tee members have been secured together and, in turn, positioned in the handrail, the frictional resistance of the spiral handrail is sufficient to prevent sliding of the handrail along the upper pin section of the tee member in the channels of the handrail.

A better understanding of the present invention will be had upon a reading of the following description when read in conjunction with the following drawing figures.

DESCRIPTION OF THE PREFERRED EMBODIMENT

Figure 1:
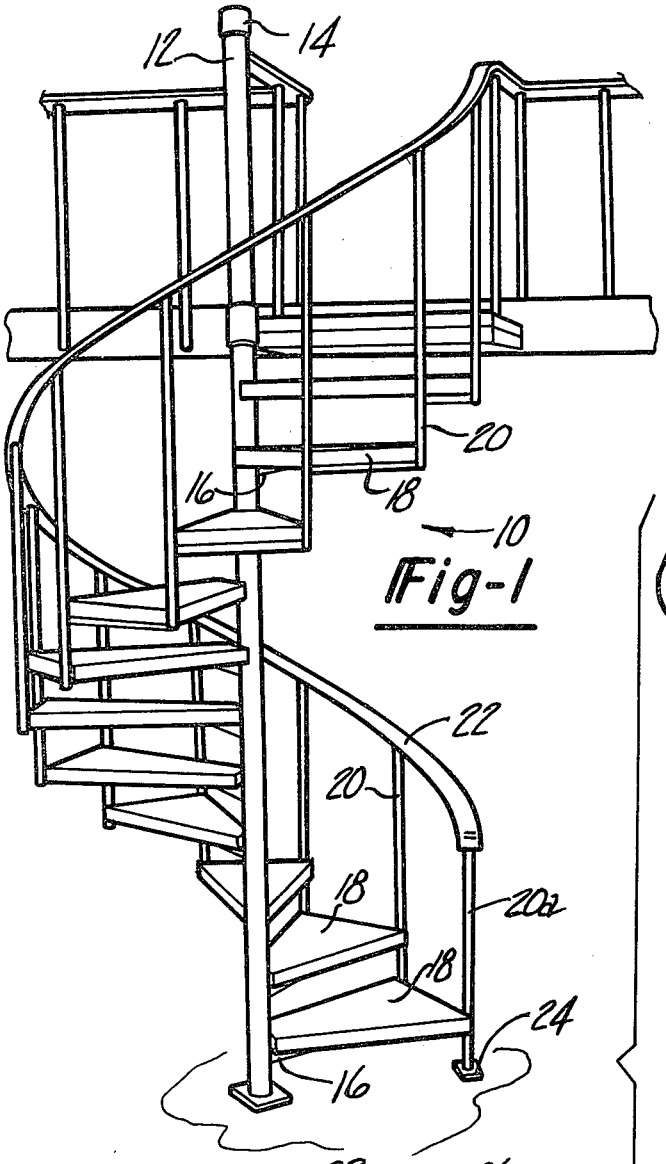
FIG. 1 is a perspective view of a spiral staircase including a one-piece handrail and using the inventive handrail assembly of the present invention.

Referring now to FIG. 1, a spiral staircase 10 is thereshown as having a support column or center pole 12 with a cap 14 at the top thereof. The center pole 12 has tread supports 16 firmly attached thereto so as to support treads 18. The extending edges of the treads 18 support balusters 20 which, in turn, support a one-piece handrail 22. The bottommost baluster **20*a* is also supported on the ground by a foot 24**.

Figure 2:
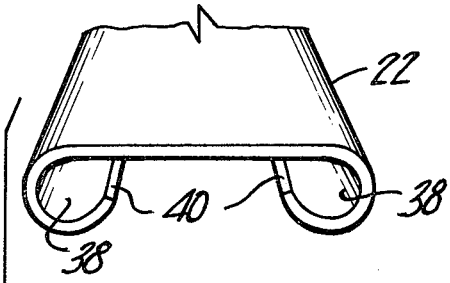
FIG. 2 is an exploded view, broken in part, showing the baluster, tee member, and handrail of the invention.
Figure 2:
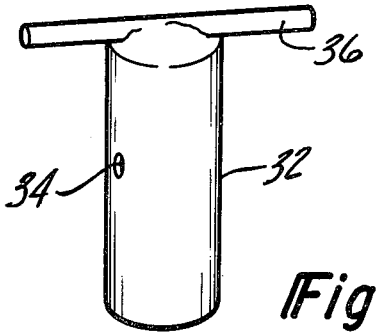

The handrail 22 is supported above post 20 by a support mechanism according to the invention and, as shown in the exploded view of FIG. 2. Although a foot 24 having four attachment bolts 26 formed therein is shown in FIG. 2, other means of attaching the posts 20 to the floor or to the associated treads 18 are also usable with the invention.

Baluster 20 is formed in a cylindrical shape in this preferred embodiment and has an upper portion formed with screw holes 28 to receive screw 30 for attachment of tee member 32 which has a mating screw hole 34. Tee member 32 is formed with an upper transverse pin 36 which is disposed in a horizontal position.

Pin 36 engages in the channels 38 of the handrail 22. Channels 38 are formed by curving the side portions of handrail 22 back under so as to leave edges 40 spaced somewhat from the bottom side of handrail 22. In this manner, the pin 36 may be inserted against the bottom of rail 22 so as to be substantially parallel therewith and then rotated around the axis of the lower portion of tee member 32 so that the pin 36 engages in the channels 38 of rail 22.

Once the balusters 20 are positioned and secured to either the floor or corresponding treads 18, the tee member 32 may be slightly adjusted so as to align the holes 28 and 34 while maintaining the pin 36 in channels 38 of the rail 22. When the holes are aligned so that the rail is supported by pin 36, screw 30 is inserted to secure the tee member 32 to the baluster 20. It can be readily appreciated that the holes 28 and 34 may be preformed without precision alignment but in such a manner so as to allow minor adjustment of the tee member 32 before securing the tee member 32 to the baluster 20.

Figure 5:
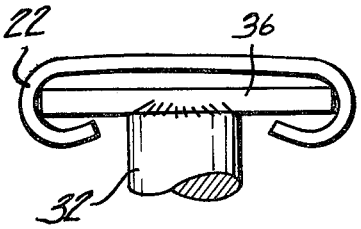
FIG. 5 is a side view of a portion of the tee member positioned in the channels of the handrail so as to support the handrail.

Thus, final assembly of the various tee members 32 with upper pin members 36 in the handrail 22 appears as in FIG. 5.

Figure 3:
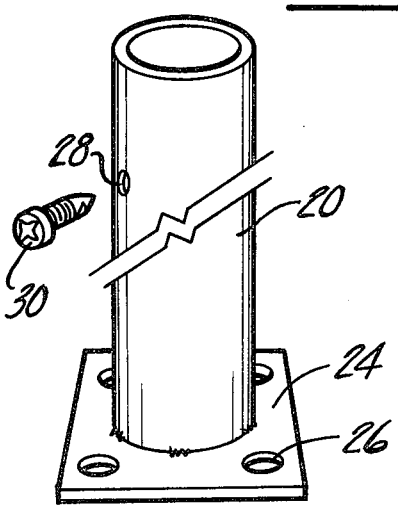
FIG. 3 is a top view of a broken section of the handrail showing the upper horizontal pin of the tee member in phantom and having the tee member positioned at somewhat of an angle so that the pin is loosely positioned in the handrail.
Figure 3:
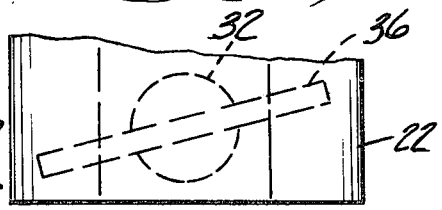
Figure 4:
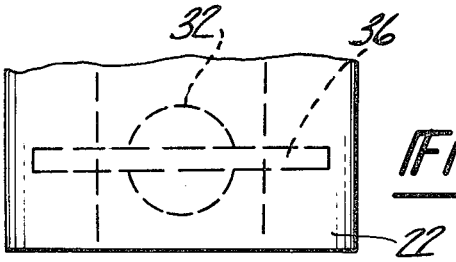
FIG. 4 is a view similar to that of FIG. 3 and showing the upper pin of the tee member in phantom but showing the pin rotated to a position perpendicular to the channels of the handrail.

FIGS. 3 and 4 show two positions wherein the pin 36 may be adjusted while still adequately engaging the rail and supporting the rail in position above balusters 20.

It should be realized that once a number of the tee members 32 are positioned so that pins 36 are relatively perpendicular to the rail 22, the rail is essentially immobile due to the frictional engagement of the pins along the edges 40 of the rail and against the sides of channels 38. It should also be realized that the tee members 32 and handrail 22 need not be formed so as to require tight fitting engagement of pins 36 in the channels 38. Rather, it is an advantage of this invention that these members may be mass produced without precision equipment. Once a plurality of the tee members 32 are secured in position in the rail and secured to balusters 20, the rail is not only immovable but safe for use with spiral staircases.

Alternative embodiments include balusters and tee member lower portions having corresponding cross sections in square or hexagonal, for example. It should also be recognized that according to the invention, the rail member may have sides which are bent somewhat differently but nevertheless provide corresponding channels to receive pin 36. That is, it is not necessary that the channels 38 be formed by a rounded turn. Alternatively, the edges of the rails could be formed by making three square corners to upturn the edges 40 underneath the rail and provide channels 38 of square or rectangular cross section. However, the rounded, turned under formation of the invention is preferred to present a somewhat safer and more aesthetically appealing handrail for use with spiral staircases.

It is possible to vary the formation of the turned under handrail, the cross section of the balusters and tee members, and other aspects of the invention without departing from the scope or spirit of the invention.

Therefore, what I claim is:

1. A handrail assembly for use with a staircase having treads, said assembly comprising:

a continuous rail having a top and a pair of return bent and downwardly depending flanges, said flanges forming a pair of facing channels between the side walls along the length of said rail, each flange having a free edge positioned underneath the top, said free edges being spaced apart from each other and forming a slot therebetween;

a tee member having a lower portion and an upper pin secured transversely across the upper end of the lower portion, said pin insertable into said pair of channels through said slot, said pin having a length substantially the same as the spacing between the side walls so that, with said pin positioned transversely across said rail and within said channels, the ends of the pin frictionally engage said side walls, an elongated post having one end secured to and extending upwardly from at least one of said treads; and means for fixedly securing the lower portion of said tee member to the other end of said post.

2. The invention as defined in claim 1 wherein the lower portion of said tee member and said other end of said post are telescopically secured together.

3. The invention as defined in claim 1 wherein said other end of said post is tubular and slidably receives the lower portion of said tee member within its interior.

4. The invention as defined in claim 3 wherein said post and said lower portion are cylindrical in cross section.

5. The invention as defined in claim 1 wherein said securing means comprises a screw threadably secured through registering holes in said lower portion and said post.

6. The invention as defined in claim 1 wherein said rail is of a single-piece construction.

* * * * *

UNITED STATES PATENT AND TRADEMARK OFFICE

CERTIFICATE OF CORRECTION

PATENT NO. : 4,373,310

DATED : February 15, 1983

INVENTOR(S) : Robert Dean

It is certified that error appears in the above—identified patent and that said Letters Patent is hereby corrected as shown below:

Column 1, line 17, delete "require" and insert --required--.

Signed and Sealed this

*Twenty-fourth* Day of *May 1983*

[SEAL]

*Attest:*

DONALD J. QUIGG

*Attesting Officer*

*Acting Commissioner of Patents and Trademarks*